United States Patent [19]

Kwon et al.

[11] Patent Number: 4,883,628

[45] Date of Patent: Nov. 28, 1989

[54] METHOD FOR PREPARING TENACITY AND MODULUS POLYACRYLONITRILE FIBER

[75] Inventors: Young D. Kwon, Morristown; Sheldon Kavesh, Whippany; Dusan C. Prevorsek, Morristown, all of N.J.

[73] Assignee: Allied-Signal Inc., Morris Township, Morris County, N.J.

[21] Appl. No.: 910,245

[22] Filed: Sep. 18, 1986

Related U.S. Application Data

[63] Continuation of Ser. No. 557,984, Dec. 5, 1983, abandoned.

[51] Int. Cl.[4] ..... D01F 6/18

[52] U.S. Cl. ..... 264/178 F; 264/182; 264/206; 264/210.8; 264/211.15; 264/211.16; 264/290.5

[58] Field of Search ..... 264/178 F, 182, 206, 264/210.8, 290.5, 211.14–211.17

[56] References Cited

U.S. PATENT DOCUMENTS

| | | | |
|---|---|---|---|
| 3,124,629 | 3/1964 | Knudsen | 264/233 |
| 3,558,765 | 1/1971 | Bruner et al. | 264/233 |
| 3,647,770 | 3/1972 | Gump et al. | 264/236 |
| 3,655,857 | 4/1972 | Bohrer et al. | 264/206 |
| 3,842,151 | 10/1974 | Stoy et al. | 264/40.3 |
| 3,896,204 | 7/1975 | Goodman et al. | 264/206 |
| 3,984,515 | 10/1976 | Mommaerts et al. | 264/206 |
| 4,025,439 | 5/1977 | Kamada et al. | 264/206 |
| 4,066,731 | 1/1978 | Hungerford | 264/216 |
| 4,173,606 | 11/1979 | Stoy et al. | 264/206 |
| 4,344,908 | 8/1982 | Smith et al. | 264/290.5 |
| 4,413,110 | 11/1983 | Kavesh et al. | 264/205 |
| 4,421,708 | 12/1983 | Reichardt et al. | 264/210.8 |
| 4,422,993 | 12/1983 | Smith et al. | 264/290.5 |
| 4,436,689 | 3/1984 | Smith et al. | 264/205 |
| 4,439,389 | 3/1984 | Hasenauer | 264/182 |
| 4,440,711 | 4/1984 | Kwon et al. | 264/203 |
| 4,448,740 | 5/1984 | Sawanishi et al. | 264/182 |
| 4,455,273 | 6/1984 | Harpell et al. | 264/184 |
| 4,551,296 | 11/1985 | Kavesh et al. | 264/203 |

FOREIGN PATENT DOCUMENTS

| | | | |
|---|---|---|---|
| 45-1650 | 1/1970 | Japan | 264/206 |
| 45-16246 | 6/1970 | Japan | 264/182 |
| 45-40700 | 12/1970 | Japan | 264/206 |
| 48-534 | 1/1973 | Japan | 264/49 |
| 49-126923 | 12/1974 | Japan | 264/28 |
| 50-62258 | 5/1975 | Japan | 264/28 |
| 1100497 | 1/1968 | United Kingdom . | |

*Primary Examiner*—Jeffery Thurlow
*Attorney, Agent, or Firm*—Patrick L. Henry

[57] ABSTRACT

Polyacrylonitrile (PAN) fibers are prepared by forming a 2–15 weight % solution of PAN of $M_w$ at least 500,000, extruding, cooling to below the gel temperature, extracting and drying. At least one of the gel fiber, the fiber containing extraction solvent and the dried gel is stretched. The product PAN fibers have a $M_w$ at least 500,000 (e.g. 1,000,000–4,000,000 or 1,500,000–2,500,000), a tenacity at least 5 g/den (e.g., at least 7 g/den) and a secant modulus at least 100 g/den (e.g. at least 125 g/den).

25 Claims, 3 Drawing Sheets

FIG. I
A
B
C
D
E
F
8
10
11
12
13
14
15
16
18
19
20
22
23
24
25
27
28
30
31
32
33
37
38
40
41
45
47
52
54
55
56
58
61
62
63
65
66
68
72

METHOD FOR PREPARING TENACITY AND MODULUS POLYACRYLONITRILE FIBER

This application is a continuation of application Ser. No. 557,984 filed December 5, 1983, now abandoned.

DESCRIPTION

The present invention relates to a process for preparing polyacrylonitrile (PAN) fibers and fibers as produced, and especially to such a process and fiber product employing PAN of ultrahigh molecular weight.

PAN has been spun conventionally using either wet spinning (e.g., 9.5% PAN in sodium thiocyanate-water (50:50) spun into 10% sodium thiocyanate in water at −2° C. for coagulation) or dry spinning (e.g. 30% PAN in diethylformamide spun at 130° C.). Typical properties of the resultant fibers are 2.4–3.7 g/denier tenacity and 42–53 g/denier tensile molecules. See Table 1 on page 155 of S. S. Chari et al., *Fibre Science and Technology*, Vol. 15, pp. 153–60 (1981). Mention is also made of PAN fibers in U.S. Pat. No. 4,344,908 to Smith et. al. (1982) concerned primarily with polyethylene fibers. Also concerned primarily with polyethylene fibers is U.S. Pat. No. 4,413,110 of Kavesh and Prevorsek (Nov. 1, 1983).

BRIEF DESCRIPTION OF THE INVENTION

The present invention includes a gel-spinning process employing a polyacrylonitrile of very high molecular weight. Unlike wet-spinning (coagulation) processes, in gel spinning, the spun solution is cooled to below the gelling temperature before extraction of the spinning solvent.

Thus, the present invention includes process comprising the steps:

(a) forming a solution of a linear polyacrylonitrile having a weight average molecular weight at least about 500,000 in a first solvent at a first concentration of about 2 to about 15 weight percent polyacrylonitrile.

(b) extruding said solvent through an aperture, said solvent being at a temperature no less than a first temperature upstream of the aperture and being substantially at the first concentration both upstream and downstream of said aperture, (c) cooling the solvent adjacent to and downstream of the aperture to a second temperature below the temperature at which a rubbery gel is formed, forming a gel containing first solvent of substantially indefinite length, (d) extracting the gel containing first solvent with a second, volatile solvent for a sufficient contact time to form a fibrous structure containing second solvent, which gel is substantially free of first solvent and is of substantially indefinite length;

(e) drying the fibrous structure containing second solvent to form a xerogel of substantially indefinite length free of first and second solvent; and (f) stretching at least one of:

(i) the gel containing the first solvent, (ii) the fibrous structure containing the second solvent and, (iii) the xerogel, at a total stretch ratio sufficient to achieve a tenacity of at least about 5 g/denier and a secant modulus of at least about 100 g/ denier.

The present invention also includes a polyacrylonitrile fiber of weight average molecular weight at least about 500,000 and having a tenacity of at least about 5 g/denier and a secant modulus of at least about 100 g/denier. Such fibers are useful in tire cord and in the preparation of carbon fibers, especially for composition.

DETAILED DESCRIPTION OF THE INVENTION

Figure 1:
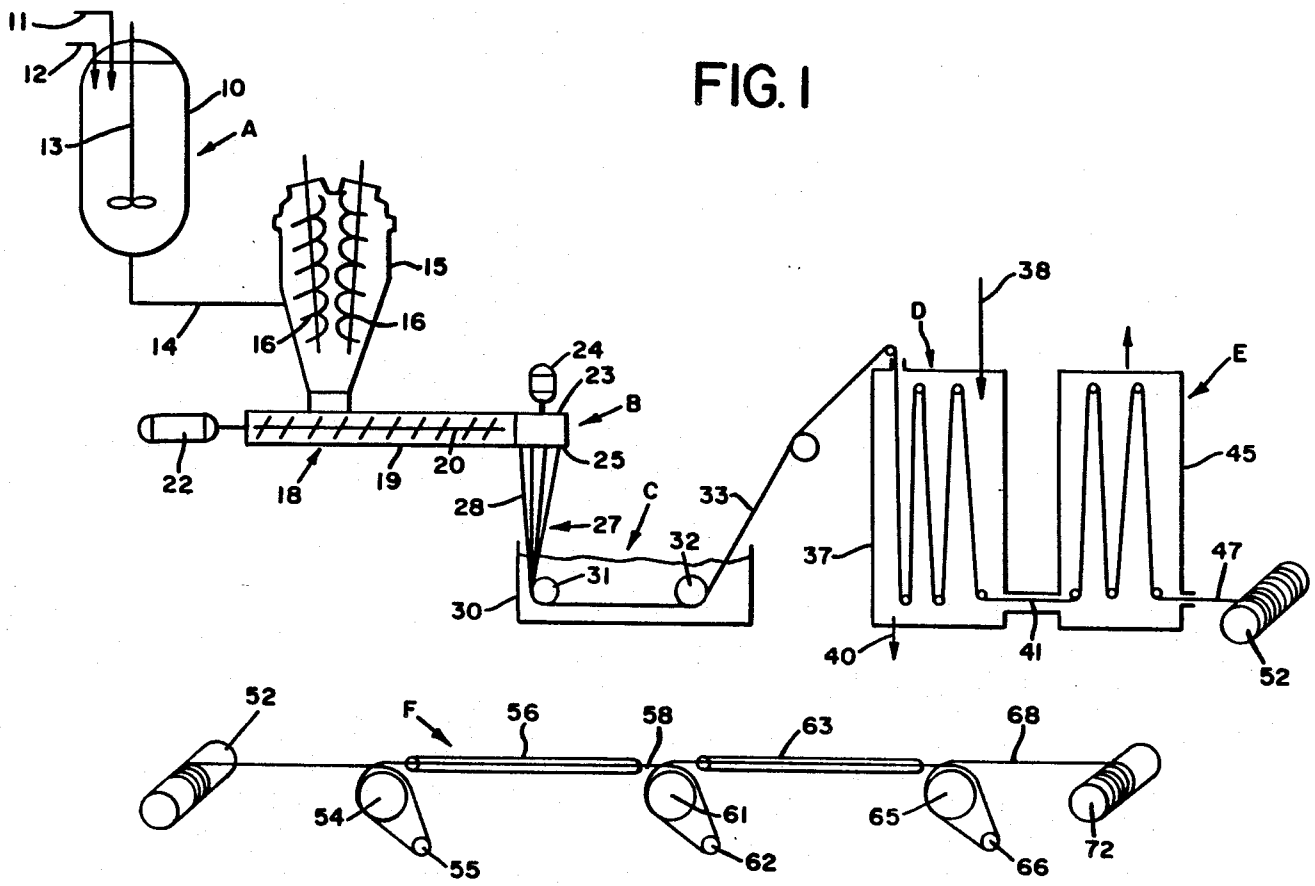

The process and fibers of the present invention employ a linear ultrahigh molecular weight polyacrylonitrile (PAN) described more fully below that enables the preparation of PAN fibers (and films) of heretofore unobtained properties by extrusion of dilute solutions of concentration lower than used in Wet Spinning or Dry Spinning. Furthermore, the preferred solvents of the present invention do not phase-separate from PAN on cooling to form a non-PAN coating or occluded phase, but rather form a dispersed fairly homogeneous gel.

The PAN polymer used is substantially linear and of weight average molecular weight at least about 500,000, preferably at least about 750,000, more preferably between about 1,000,000 and about 4,000,000 and most preferably between about 1,500,000 and about 2,500,000.

Such substantially linear ultrahigh molecular weight PAN can be prepared by the procedures illustrated in Preparations A and B immediately proceeding Example 1, below. While ultrahigh molecular weight PAN is known (see U.S. Pat. No. 4,254,250 Col. 5, Table I), its prior use was in preparing water treatment polymers.

The first solvent should be substantially non-volatile under the processing conditions. This is necessary in order to maintain essentially constant the concentration of solvent upstream and through the aperture (die) and to prevent non-uniformity in liquid content of the gel fiber or film containing first solvent. Preferably, the vapor pressure of the first solvent should be no more than 80 kPa (four-fifths of an atmosphere) at 130° C., or the first temperature. Suitable first solvents for PAN include dimethylsulfoxide (DMSO), dimethylformamide (DMF), dimethylacetamide (DMAc), gamma-butyrolactone and ethylene carbonate. Other homologs and analogs of these solvents (e.g., propylene carbonate) may also be used. Less preferred are aqueous solutions of salts such as concentrated aqueous sodium thiocyanate. DMSO is most preferred.

The polymer may be present in the first solvent at a first concentration which is selected from a relatively narrow range, e.g. about 2 to about 15 weight percent, preferably about 4 to about 10 weight percent more preferably about 5 to about 8 weight percent however, once chosen, the concentration should not vary significantly adjacent the die or otherwise prior to cooling to the second temperature. The concentration at any one point should not vary adjacent the die or otherwise prior to cooling to the second temperature. The concentration should also remain reasonably constant over time (i.e. length of the fiber or film).

The first temperature is chosen to achieve complete dissolution of the polymer in the first solvent. The first temperature is the minimum temperature at any point between where the solution is formed and the die face, and must be greater than the gelation temperature for the polymer in the solvent at the first concentration. For PAN in DMSO at 5–8% concentration, the gelation temperature is approximately 25°–100° C.; therefore, a preferred first temperature can be about 130° C. to about 200° C., more preferably about 140°–180° C. While temperatures may vary above the first temperature at various points upstream of the die face, excessive temperatures causative of polymer degradation should be avoided. To assure complete solubility, a first temperature is chosen whereat the solubility of the polymer exceeds the first concentration and is typically at least 20% greater. The second temperature is chosen whereat the first solvent-polymer system behaves as a gel, i.e., has a yield point and reasonable dimensional stability for subsequent handling. Cooling of the extruded polymer solution from the first temperature to the second temperature should be accomplished at a rate sufficiently rapid to form a gel fiber which is of substantially the same polymer concentration as existed in the polymer solution. Preferably the rate at which the extruded polymer solution is cooled from the first temperature to the second temperature should be at least 50° C. per minute.

A preferred means of cooing to the second temperature involves the use of a quench bath. The quench bath will preferably comprise a mixture of the first solvent with water. The water concentration of the quench bath may range from about 0 to about 95%. The quench bath may also comprise a liquid which is relatively immiscible with the first solvent. Suitable liquids include soybean oil, silicon oil, etc. Quenching temperatures that may be employed range from about 0° C. to about 50° C. with a temperature near room temperature being preferred.

Some stretching during cooling to the second temperature is not excluded from the present invention, but the total stretching during this stage should not normally exceed 10:1. As a result of those factors the gel fiber formed upon cooing to the second temperature consists of a continuous polymeric network highly swollen with solvent.

If an aperture of circular cross section (or other cross section without a major axis in the plane perpendicular to the flow direction more than 8 times the smallest axis in the same plane, such as oval, Y- or X-shaped aperture) is used, then both gels will be gel fibers, the xerogel will be a xerogel fiber and the thermoplastic article will be a fiber. The diameter of the aperture is not critical, with representative apertures being between 0.25 mm and 5 mm in diameter (or other major axis). The length of the aperture in the flow direction should normally be at least 10 times the diameter of the aperture (or other similar major axis), preferably at least 15 times and more preferably at least 20 times the diameter (or other similar major axis).

If an aperture of rectangular cross section is used, then both gels will be gel films, the xerogel will be a xerogel film and the thermoplastic article will be a film. The width and height of the aperture are not critical, with representative apertures being between 2.5 mm and 2 m in width (corresponding to film width), between 0.25 mm and 5 mm in height (corresponding to film thickness). The depth of the aperture (in the flow direction) should normally be at least 15 times the height and more preferably at least 20 times the height.

The extraction with second solvent is conducted in a manner that replaces the first solvent in the gel with a second more volatile solvent. When the first solvent is DMSO or DMF, a suitable second solvent is water. Preferred second solvents are the volatile solvent having an atmospheric boiling point of 100° C. or lower. Conditions of extraction should remove the first solvent to less than 1% solvent by weight of polymer in the gel after extraction.

With some first solvents such as DMSO or DMF, it is contemplated (but not preferred) to evaporate the solvent from the gel fiber near the boiling point of the first solvent and/or at subatmospheric pressure instead of or prior to extraction.

A preferred combination of conditions is a first temperature between 130° C., and 250° C., a second temperature between 0° C. and 50° C. and a cooling rate of at least 50° C./minute. The first solvent should be substantially non-volatile, one measure of which is that its vapor pressure at the first temperature should be less than four-fifths atmosphere (80 kPa). In choosing the first and second solvents, the primary desired difference relates to volatility as discussed above.

Once the fibrous structure containing second solvent is formed, it is then dried under conditions where the second solvent is removed leaving the solid network of polymer substantially intact. By analogy to silica gels, the resultant material is called herein a "xerogel" meaning a solid matrix corresponding to the solid matrix of a wet gel, with the liquid replaced by gas (e.g. by an inert gas such as nitrogen or by air). The term "xerogel" is not intended to delineate any particular type of surface area, porosity or pore size.

Stretching may be performed upon the gel fiber after cooling to the second temperature or during or after extraction. Alternatively, stretching of the xerogel fiber may be conducted, or a combination of gel stretch and xerogel stretch may be performed. The first stage stretching may be conducted in a single stage or it may be conducted in two or more stages. The first stage stretching may be conducted at room temperature or at an elevated temperature. Preferably the stretching is conducted in two or more stages with the last of the stages performed at a temperature between 100° C. and 250° C. Most preferably the stretching is conducted in at least two stages with the last of the stages performed at a temperature between 130° C. and 230° C.

Such temperature may be achieved with heated tubes as in the FIGS., or with other heating means such as heating blocks or steam jets.

The product PAN fibers produced by the present process represent novel articles in that they include fibers with a unique combination of properties: a molecular weight of at least about 500,000, a (secant) modulus at least about 100 g/denier and a tenacity at least about 5 g/denier. For this fiber, the molecular weight is preferably at least about 750,000, more preferably between about 1,000,000 and about 4,000,000 and most preferably between about 1,500,000 and about 2,500,000. The tenacity is preferably at least about 7 g/denier. The secant modulus is preferably at least about 100 g/denier, more preferably at least about 125 g/denier. Preferably the fiber has an elongation to break at most 7%.

DESCRIPTION OF THE PREFERRED EMBODIMENTS

FIG. 1, illustrates in schematic form a first embodiment of the present invention, wherein the stretching step F is conducted in two stages on the xerogel fiber subsequent to drying step E. In FIG. 1, a first mixing vessel 10 is shown, which is fed with an ultra high molecular weight polymer 11 such as PAN of weight average molecular weight at least 500,000 and frequently at least 750,000, and to which is also fed a first, relatively non-volatile solvent 12 such as DMSO. First mixing vessel 10 is equipped with an agitator 13. The residence time of polymer and first solvent in first mixing vessel 10 is sufficient to form a slurry containing some dissolved polymer and some relatively finely divided polymer particles, which slurry is removed in line 14 to an intensive mixing vessel 15. Intensive mixing vessel 15 is equipped with helical agitator blades 16. The residence time and agitator speed in intensive mixing vessel 15 is sufficient to convert the slurry into a solution. It will be appreciated that the temperature in intensive mixing vessel 15, either because of external heating, heating of the slurry 14, heat generated by the intensive mixing, or a combination of the above is sufficiently high (e.g. 150° C.) to permit the polymer to be completely dissolved in the solvent at the desired concentration (generally between 5 and 10 percent polymer by weight of solution). From the intensive mixing vessel 15, the solution is fed to an extrusion device 18, containing a barrel 19 within which is a screw 20 operated by motor 22 to deliver polymer solution at reasonably high pressure to a gear pump and housing 23 at a controlled flow rate. A motor 24 is provided to drive gear pump 23 and extrude the polymer solution, still hot, through a spinnerette 25 comprising a plurality of apertures, which may be circular, X-shaped, or, oval-shaped, or in any of a variety of shapes having a relatively small major axis in the plane of the spinnerette when it is desired to form fibers, and having a rectangular or other shape with an extended major axis in the plane of the spinnerette when it is desired to form films. The temperature of the solution in the mixing vessel 15, in the extrusion device 18 and at the spinnerette 25 should all equal or exceed a first temperature (e.g. 150° C.) chosen to exceed the gellation temperature (approximately 0°-100° C. for PAN in DMSO). The temperature may vary (e.g. 140° C., 160° C.) or may be constant (e.g. 150° C.) from the mixing vessel 15 to extrusion device 18 to the spinnerette 25. At all points, however, the concentration of polymer in the solution should be substantially the same. The number of apertures, and thus the number of fibers formed, is not critical, with convenient numbers of apertures being 16, 120, or 240.

From the spinnerette 25, the polymer solution passes through an air gap 27, optionally enclosed and filled with an inert gas such as nitrogen, and optionally provided with a flow of gas to facilitate cooling. A plurality of gel fibers 28 containing first solvent pass through the air gap 27 and into a quench bath 30 containing any of a variety of liquids, so as to cool the fibers, both in the air gap 27 and in the quench bath 30, to a second temperature such that the polymer-solvent system forms a gel. It is preferred that the quench liquid in quench batch 30 be a mixture of first solvent (DMSO) and water. While some stretching in the air gap 27 and in the quench medium is permissible, it is preferably less than about 10:1. Rollers 31 and 32 in the quench bath 30 operate to feed the fiber through the quench bath, and preferably operate with little or no stretch.

From the quench bath 30, the cool first gel fibers 33 pass (preferably with some room temperature stretching) to a solvent extraction device 37 where a second solvent, being of relatively low boiling temperature such as water, is fed through line 38. The solvent outflow in line 40 contains second solvent and essentially all of the first solvent brought in with the cool gel fibers 33, either dissolved or dispersed in the second solvent. Thus the fibrous structure 41 conducted out of the solvent extraction device 37 contains substantially only second solvent, and relatively little first solvent. The fibrous structure 41 may have shrunken somewhat compared to the first gel fibers 33.

In a drying device 45, the second solvent is evaporated from the fibrous structure 41, forming essentially unstretched xerogel fibers 47 which are taken up on spool 52.

From spool 52, or from a plurality of such spools if it is desired to operate the stretching line at a slower feed rate than the take up of spool 52 permits, the fibers are fed over driven feed roll 54 and idler roll 55 into a first heated tube 56, which may be rectangular, cylindrical or other convenient shape. Sufficient heat is applied to the tube 56 to cause the fiber temperature to be between 100°-200° C. The fibers are stretched at a relatively high draw ratio (e.g. 4:1) so as to form partially stretched fibers 58 taken up by driven roll 61 and idler roll 62. From rolls 61 and 62, the fibers are taken through a second heated tube 63, heated so as to be at somewhat higher temperature, e.g. 130°-230° C. and are then taken up by driven take-up roll 65 and idler roll 66, operating at a speed sufficient to impart a stretch ratio in heated tube 63 as desired, e.g. 1.8:1. The twice stretched fibers 68 produced in this first embodiment are taken up on take-up spool 72. It is anticipated that some or all of the stretch ratios may be decreased as the line speeds are increased.

With reference to the six process steps of the present invention, it can be seen that the solution forming step A is conducted in mixers 13 and 15. The extruding step B is conducted with device 18 and 23, and especially through spinnerette 25. The cooling step C is conducted in airgap 27 and quench bath 30. Extraction step D is conducted in solvent extraction device 37. The drying step E is conducted in drying device 45. The stretching step F is conducted in elements 52-72, and especially in heated tubes 56 and 63. It will be appreciated, however, that various other parts of the system may also perform some stretching, even at temperatures substantially below those of heated tubes 56 and 63. Thus, for example, some stretching (e.g. 1.5:1 to 5:1) may occur within quench bath 30, between the quench bath 30 and the solvent extraction device 37, within solvent extraction device 37, within drying device 45 or between solvent extraction device 37 and drying device 45.

Figure 2:
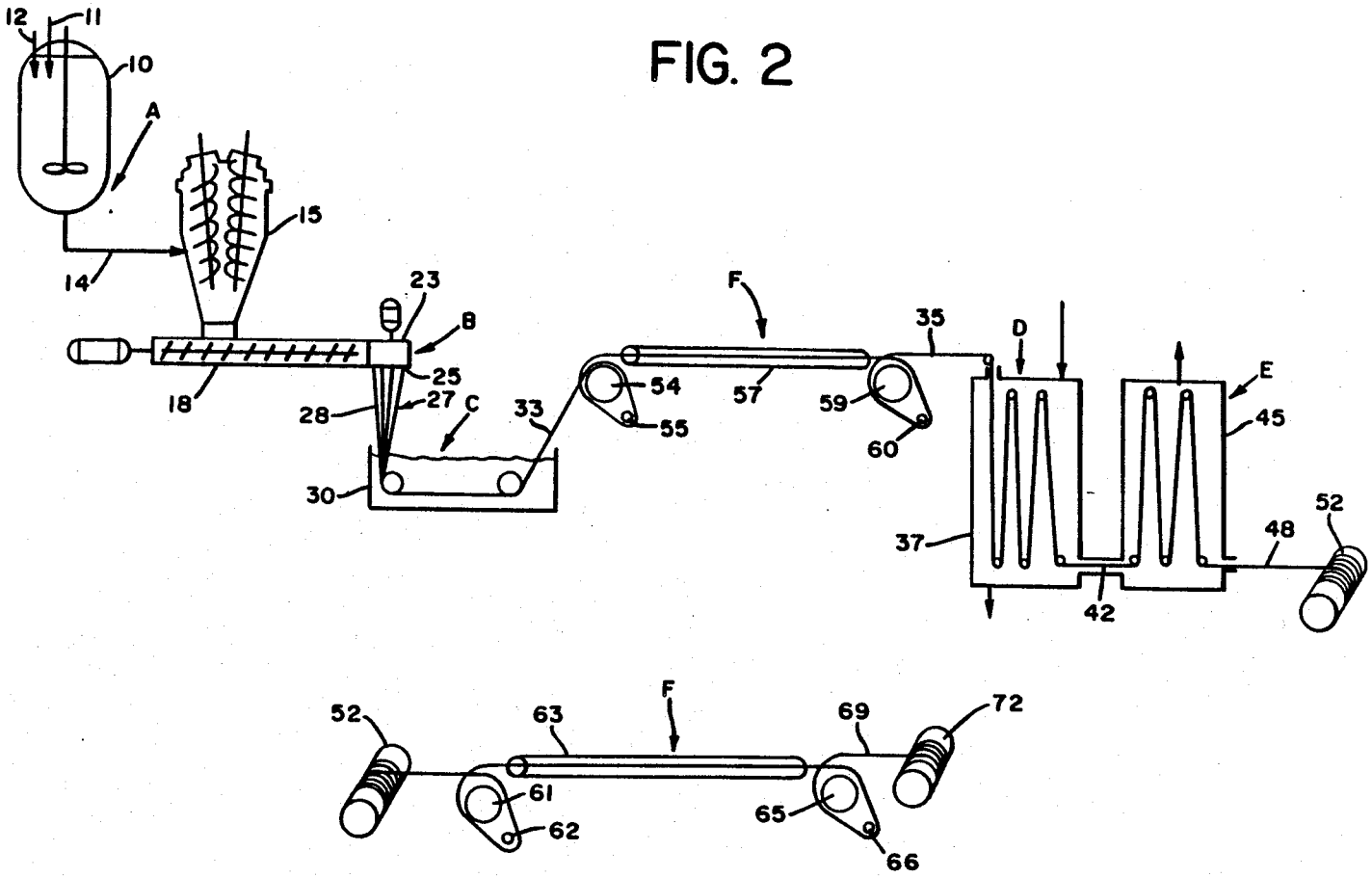

A second embodiment of the present invention is illustrated in schematic form by FIG. 2. The solution forming and extruding steps A and B of the second embodiment are substantially the same as those in the first embodiment illustrated in FIG. 1 Thus, polymer and first solvent are mixed in first mixing vessel 10 and conducted as a slurry in line 14 to intensive mixing device 15 operative to form a hot solution of polymer in first solvent. Extrusion device 18 impells the solution under pressure through the gear pump and housing 23 and then through a plurality of apertures in spinnerette 27. The hot first gel fibers 28 pass through air gap 27 and quench bath 30 so as to form cool first gel fibers 33.

The cool first gel fibers 33 are conducted over driven coil 54 and idler roll 55 through heated tube 57 which, in general, is longer than the first heated tube 56 illustrated in FIG. 5. The fibers 33 are drawn through heated tube 57 by driven take-up roll 59 and idler roll 60, so as to cause a relatively high stretch ratio (e.g. 10:1). The once-stretched first gel fibers 35 are conducted into extraction device 37.

In the extraction device 37, the first solvent is extracted out of the gel fibers by second solvent and the fibrous structures 42 containing second solvent are conducted to a drying device 45. There the second solvent is evaporated from the fibrous structures; and xerogel fibers 48, being once-stretched, are taken up on spool 52.

Fibers on spool 52 are then taken up by driven feed roll 61 and idler 62 and passed through a heated tube 63, operating at the relatively high temperature of between 150° and 270° C. The fibers are taken up by driven take up roll 65 and idler roll 66 operating at a speed sufficient to impart a stretch in heated tube 63 as desired, e.g. 1.8:1. The twice-stretched fibers 69 produced in the second embodiment are then taken up on spool 72.

It will be appreciated that, by comparing the embodiment of FIG. 2 with the embodiment of FIG. 1, the stretching step F has been divided into two parts, with the first part conducted in heated tube 57 performed on the first gel fibers 33 prior to extraction (D) and drying (E), and the second part conducted in heated tube 63, being conducted on xerogel fibers 48 subsequent to drying (E).

Figure 3:
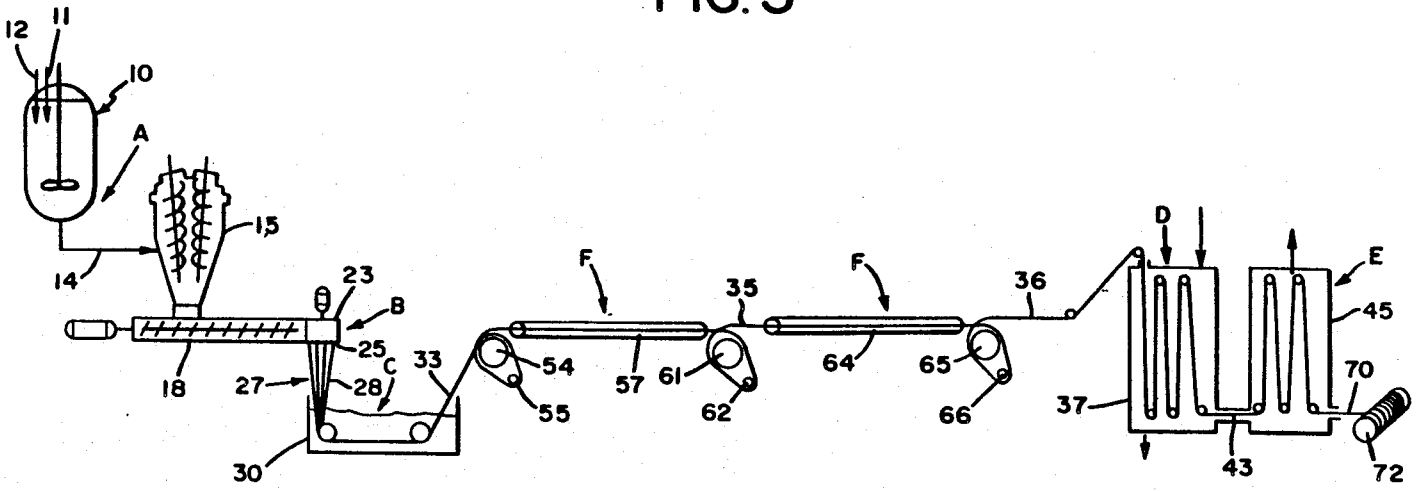

The third embodiment of the present invention is illustrated or FIG. 3, with the solution forming step A, extrusion step B, and cooling step C being substantially identical to the first embodiment of FIG. 1 and the second embodiment of FIG. 2. Thus, polymer and first solvent are mixed in first mixing vessel 10 and conducted as a slurry in line 14 to intensive mixing device 15 operative to form a hot solution of polymer in first solvent. Extrusion device 18 impells the solution under pressure through the gear pump and housing 23 and then through a plurality of apertures in spinnerette 27. The hot first gel fibers 28 pass through air gap 27 and quench bath 30 so as to form cool first gel fibers 33.

The cool first gel fibers 33 are conducted over driven roll 54 and idler roll 55 through a heated tube 57 which, in general, is longer than the first heated tube 56 illustrated in FIG. 5. The length of heated tube 57 compensates, in general, for the higher velocity of fibers 33 in the third embodiment of FIG. 7 compared to the velocity of xerogel fibers (47) between take-up spool 52 and heated tube 56 in the first embodiment of FIG. 1. The first gel fibers 33 are now taken up by driven roll 61 and idler roll 62, operative to cause the stretch ratio in heated tube 57 to be as desired, e.g. 5:1.

From rolls 61 and 62, the once-drawn first gel fibers 36 are conducted into modified heated tube 64 and drawn by driven take up roll 65 and idler roll 66. Driven roll 65 is operated sufficiently fast to draw the fibers in heated tube 64 at the desired stretch ratio, e.g. 1.8:1. Because of the relatively high line speed in heated tube 64, required generally to match the speed of once-drawn gel fibers 35 coming off of rolls 61 and 62, heated tube 64 in the third embodiment of FIG. 3 will, in general, be longer than heated tube 63 in either the second embodiment of FIG. 2 or the first embodiment of FIG. 1. While first solvent may exude from the fiber during stretching in heated tubes 57 and 64 (and be collected at the exit of each tube), the first solvent is sufficiently non-volatile so as not to evaporate to an appreciable extent in either of these heated tubes.

The twice-stretched first gel fiber 36 is then conducted through solvent extraction device 37, where the second, volatile solvent extracts the first solvent out of the fibers. The fibrous structures 43, containing substantially only second solvent, are then dried in drying device 45, and the twice-stretched fibers 70 are then taken up on spool 72.

It will be appreciated that, by comparing the third embodiment of FiG. 3 to the first two embodiments of FIGS. 1 and 2, the stretching step (F) is performed in the third embodiment in two stages, both subsequent to cooling step C and prior to solvent extracting step D.

The present polyacrylonitrile fibers may be used as such in tire cord and other applications. In addition, they may be carbonized or graphitized, in the manner conventionally employed for polyacrylonitrile fibers (see Kirk-Othmer, Encyclopedia of Chemical Technology, vol. 4 pp. 625–26 (1978); British Pat. No. 1,110,791 (Apr. 24, 1968)) and the above-cited Chari et al article) to produce carbon fibers of superior properties.

The polyacrylonitrile used in the following Examples was prepared by the procedure illustrated below in Preparation C.

PREPARATION A

The reactor consisted of a 1-liter, 3-neck, round-bottom flask with indented wall. It was fitted with a stirrer, a condenser, and a stopper. The flask is placed in a constant temperature bath at 35° C. It was evacuated and filled with oxygen-free nitrogen four times using a Firestone valve. The system was blanketed with nitrogen throughout the polymerization period.

A mixture of 300 mL freshly boiled, deionized, and distilled water, 3 g of sodium lauryl sulfate, and 2 mL of 0.1N $H_2SO_4$ solution was added and stirred. To this was added 100 mL (80 g) of redistilled acrylonitrile and stirred vigorously to form an emulsion. After 5 minutes, 0.2 g of potassium persulfate and 0.08 g of sodium metabisulfite were added. The mixture was stirred for 22 hours under nitrogen. The emulsion formed was mixed with 600 mL of methanol with stirring. The polymer precipitated was isolated by filtration. It was purified by washing twice using hot water (50°–60° C.) with vacuum filtration, followed by drying to a constant weight. There was obtained 78 g (98% yield) of polyacrylonitrile having an intrinsic viscosity of 9.92 dL/g when determined in N,N-dimethylformamide at 35° C. This was calculated to have an estimated molecular weight of $1.06\times10^6$ using the following equation:

$$[\eta]=3.17\times10^{-4}M^{0.746}$$

PREPARATION B

A similar procedure was used in this experiment. A 500-ml flask was charged with a mixture of 150 mL of deaerated, deionized, and distilled water, 1.5 g sodium lauryl sulfate, 1 mL of 0.1N $H_2SO_4$, 50 l of redistilled acrylonitrile, 0.1 g of $K_2S_2O_8$ and 0.04 g of $Na_2S_2O_5$, in that order.

After stirring for 1 hour at 35° C., another batch of 0.1 g $K_2L_2O_8$ and 0.04 g of $Na_2S_2O_5$ was added. The mixture was stirred vigorously under nitrogen for four more hours and then treated with methanol. The precipitated polymer was filtered, washed twice with hot water, and dried. There was obtained 37.1 g (93% yield) of polyacrylonitrile.

The intrinsic viscosity was found to be 5.67 dL/g when measured in N,N-dimethylformamide at 35° C. On the basis described in Preparation A, this corresponds to an estimated molecular weight of $5.5\times10^5$.

PREPARATION C

A 500 ml 3-neck flash equipped with a stirrer, a condenser and s stopper was flushed well and blanketed with nitrogen. A mixture containing 120 ml of deaerated, deionized water, 2 g of sodium lauryl sulfate, 80 g of purified acrylonitrile, 0.1 g of potassium persulfate, and 0.03 g of sodium metabisulfate, was added. The mixture was stirred vigorously at 35° C. for 1 hour. Another batch of 0.1 g of potassium persulfate and 0.03 g of sodium metabisulfate was added. After stirring for 24 hours under an atmosphere of nitrogen, the mixture was mixed with 1.5 L of water and 150 g of sodium chloride. The polymer formed was obtained by filtration and then washed four times with water until the filtrate was free of chloride. The polyacrylonitrile was collected by filtration and dried in air at room temperature. Its intrinsic viscosity was found to be 13.65 dL/g when measured in N,N-dimethylformamide at 35° C. This was calculated to have an estimated molecular weight of $1.63\times10^6$ using the equation given in Preparation A.

The process of the invention will be illustrated by the examples below.

EXAMPLES

The modulus values reported in Example 1–4 represent secant modulus (the slope of a chord on the stress-strain curve drawn between the origin and the breaking point). Such secant modulus values are normally lower than the initial modulus, in some cases by a factor of 2. Selected fibers were also evaluate for initial modulus, and both values are given in Table 1 at the end of the Examples.

EXAMPLE 1

An Atlantic Research Corporation Model 2CV Helicone® mixer charged with a 6.0 weight percent solution of the PAN prepared in Preparation C, having a molecular weight of approximately $1.63\times10^6$, and 94 weight percent dimethyl sulfoxide. The charge was heated with agitation at 12 rev/min at 25° C. under nitrogen pressure for two hours and then for two hours at 145° C.

The solution was extruded at the final mixing temperature (i.e. 145°) through a 0.030 inch (0.762 mm) diameter aperture (L/D=25) at a reasonably constant rate of 2.03 $cm^3$/min.

The extruded uniform solution filament was quenched to a gel state by passage through a bath comprising 50 weight percent water and 50 weight percent dimethyl sulfoxide, said bath being located 1 cm below the spinning die. The gel filament was wound up continuously on a 6.5 cm diameter, 20.4 cm long bobbin at the rate of 599 cm/min.

The gel fiber was then kept in a stirred water bath having a temperature of 22° C. for 18 hours in order to extract the dimethyl sulfoxide from the fiber. Thereafter, the fiber was dried at a temperature of 25° C. Drying of the fiber was accomplished by leaving in air at room temperature.

The dried fiber was then drawn via a two stage drawing process. First stage drawing was accomplished by feeding the fiber at a speed of 118 cm/min into a hot tube, five-eighths inch (14 mm) inside diameter, and 6 feet (180 cm) in length, blanketed with nitrogen. The temperature at the entrance of the hot tube was 135° C. with the exit temperature of the hot tube being 150° C. The fiber was drawn at a ratio of 4.07/1 within the tube. Second stage drawing of the once stretched fiber was accomplished by drawing the fiber in the same tube wherein the fiber was fed into the tube at a speed of 215 cm/min, with the tube entrance temperature being 146° C., the tube exit temperature being 160° C., and the drawing ratio being 2.11/1. The properties of the twice stretched fiber was as follows:

denier: 10.5
tenacity: 7.8 g/denier
secant modulus: 138 g/denier
ultimate elongation: 5.8

EXAMPLE 2

Example 1 was repeated with 6% PAN in DMSO and the extrusion rate lowered from 2.03 to 1.97 $cm^3$/min and the take-up speed raised from 599 cm/min to 605 cm/min (so as to produce a die-draw of 1.4:1 instead of 1.35:1). Six sets of fibers were prepared using various first stretch conditions (tube temperature, draw ratio, draw duration) as follows:

| Run | Feed Speed (cm/min) | Tube Temp (°C.) Entrance | Tube Temp (°C.) Exit | Draw Ratio | Duration (min) |
|---|---|---|---|---|---|
| 2A | 118 | 135 | 150–155 | 3.80 | 21 |
| 2B | 118 | 135 | 150–55 | 4.07 | 21.5 |
| 2C | 116 | 135 | 150–55 | 4.35 | 22.0 |
| 2D | 118 | 135 | 155–58 | 4.59 | 24.0 |
| 2E | 119 | 135 | 155–58 | 4.98 | 22.0 |
| 2F | 120 | 135 | 155–58 | 5.50 | 33.0 |

Fiber properties were measured (4 replications) on such once-drawn fibers, and are indicated below, with average values indicated, followed by maximum values in parentheses:

| Fiber | Denier | Tenacity (g/den) Ave (Max) | Modulus (g/den) Ave (Max) | Elongation (%) Ave (Max) |
|---|---|---|---|---|
| 2A | 28 | 3.54 (3.65) | 45 (49) | 7.3 (8.0) |
| 2B | 27.5 | 3.93 (3.96) | 43 (44) | 9.2 (9.5) |
| 2C | 26.5 | 4.07 (4.28) | 51 (53) | 8.0 (8.7) |
| 2D | 26 | 3.61 (4.02) | 62 (69) | 5.9 (7.3) |
| 2E | 23 | 4.71 (4.93) | 64 (65) | 7.4 (7.7) |
| 2F | 23 | 4.64 (5.03) | 62 (63) | 7.5 (8.5) |

The once-drawn fibers were then drawn again under conditions indicated below:

| Once Drawn Fiber | Run | Feed Speed (cm/min) | Tube Temp (°C.) Entrance | Tube Temp (°C.) Exit | Draw Ratio | Duration (min) |
|---|---|---|---|---|---|---|
| 2A | 1 | 215 | 146 | 160–66 | 1.49 | 15 |
| 2A | 2 | 214 | 146 | 160–66 | 1.83 | 11 |
| 2B | 1 | 215 | 146 | 160–66 | 2.11 | 16 |
| 2B | 2 | 215 | 146 | 160–66 | 2.18 | 7.5 |
| 2C | 1 | 214 | 146 | 160–66 | 2.15 | 29 |
| 2D | 2 | 212 | 146 | 160–66 | 1.95 | 10.2 |
| 2D | 3 | 212 | 145 | 162–68 | 1.98 | 19 |
| 2F | 1 | 213 | 145 | 159–62 | 1.69 | 30 |
| 2F | 2 | 213 | 145 | 159–62 | 1.75 | 11 |

The properties of the twice-stretched fibers were then measured (at least three replications), with the results indicated below:

| | Denier | Tenacity (g/den) Ave. (Max.) | Modulus (g/den) Ave. (Max.) | Elongation (%) Ave. (Max.) |
|---|---|---|---|---|
| 2A1 | 14.5 | 6.0 (6.3) | 99 (101) | 6.0 (6.7) |
| 2B1 | 12.5 | 6.9 (7.6) | 113 (118) | 6.1 (7.0) |
| 2B2 | 10.5 | 7.5 (7.8) | 135 (138) | 5.5 (5.8) |

-continued

| | Denier | Tenacity (g/den) Ave. (Max.) | Modulus (g/den) Ave. (Max.) | Elongation (%) Ave. (Max.) |
|---|---|---|---|---|
| 2C1 | 14 | 6.4 (6.8) | 107 (110) | 6.0 (6.3) |
| 2D1 | 14.5 | 6.5 (7.2) | 105 (109) | 6.2 (6.6) |
| 2D2 | 12.5 | 7.0 (7.8) | 118 (123) | 5.9 (6.2) |
| 2F1 | 12.5 | 7.5 (8.0) | 126 (128) | 6.0 (6.3) |
| 2F2 | 13 | 7.2 (7.7) | 123 (127) | 5.9 (6.4) |

EXAMPLE 3

Example 1 was repeated, now mixing the PAN to 6.0% concentration in gamma-butyrolactone for four hours at 145° C. Spinning was at 145° C., at 2.17 mL/min into water-methanol (50:50). Take-up speed was 617 cm/min (1.3:1 die-draw). The fibers were extracted at 22° C. for 18 hours in stirred methanol. The fibers were twice drawn as follows:

| | First Draw* | | Second Draw | | | | |
|---|---|---|---|---|---|---|---|
| Fiber | Ratio | Duration | Feed | Enter | Exit | Ratio | Duration |
| 3A1 | 5.05 | 14.0 | 194 | 145 | 158–62 | 1.53 | 9.5 |
| 3A2 | 5.05 | 14.0 | 192 | 145 | 158–62 | 1.70 | 3.0 |
| 3A3 | 5.05 | 14.0 | 192 | 150 | 170–74 | 1.70 | 4.0 |
| 3A4 | 5.05 | 14.0 | 192 | 175 | 197–201 | 1.66 | 2.0 |
| 3B1 | 5.51 | 19.0 | 192 | 140 | 165–70 | 1.37 | 8.8 |
| 3C1 | 5.81 | 16.0 | 191 | 140 | 165–70 | 1.23 | 33.0 |

*First draw in a tube 120° C. at entrance, 140–45° C. at exit, feed speed 98–100 cm/min.

Properties of selected fibers were measured on a Instron® tensile testing machine as follows:

| | Denier | Tenacity (g/den) | Modulus (g/den) | Elongation (%) |
|---|---|---|---|---|
| 3A1 | 17 | 5.0 (5.5) | 96 (100) | 5.2 (5.7) |
| 3A2 | 19 | 4.5 (5.0) | 96 (99) | 4.8 (5.3) |
| 3A3 | 16.5 | 5.0 (5.2) | 95 (100) | 5.2 (5.3) |
| 3B1 | 21 | 4.2 (4.7) | 86 (97) | 4.9 (5.2) |
| 3C1 | 22 | 3.9 (4.0) | 75 (86) | 5.1 (5.4) |

EXAMPLE 4

Example 1 was repeated using 6.0% PAN in dimethyl formamide, mixed at 145° C. for four hours. Spinning through the 0.030 inch (0.78 mm) diameter die was at 133° C. at 1.96 mL/min with take-up at 519 cm/min (1.20:1 die-draw). Extraction was in water for 17 hours with stirring and then 4 hours without stirring. Two stage drawing was as follows:

| | First Draw* | | Second Draw | |
|---|---|---|---|---|
| | Feed | Ratio | Ratio | Duration |
| 4A1 | 120 | 5.06 | 1.51 | 13.3 |
| 4A2 | 120 | 5.06 | 1.58 | 4.5 |
| 4B1 | 120 | 5.44 | 1.45 | 21.3 |
| 4B2 | 120 | 5.44 | 1.50 | 15.0 |
| 4C1 | 111 | 5.88 | 1.45 | 4.3 |
| 4C2 | 111 | 5.88 | 1.38 | 15.0 |

*The tube for the first draw was 120° C. at the entrance, 130–35° C. at the exit; the duration was 20 minutes for each of the three first draw conditions. All second draws were at 200 (±1) cm/min feed, 140° C. tube entrance and 154–60° C. tube exit.

Fiber properties were determined (one replication for the three once-drawn fibers, four replications for the six twice-drawn fibers) as follows:

| | Denier | Tenacity Ave (Max) | Modulus Ave (Max) | Elongation Ave (Max) |
|---|---|---|---|---|
| 4A | 10.5 | 5.6 (6.1) | 99 (102) | 5.9 (6.3) |
| 4B | 15 | 4.6 | 82 | 5.7 |
| 4C | 17 | 4.3 | 74 | 5.8 |
| 4A1 | 7.5 | 6.0 (7.0) | 111 (117) | 5.4 (6.0) |
| 4A2 | 8.0 | 5.8 (6.0) | 103 (107) | 5.7 (5.9) |
| 4B1 | 14.0 | 5.4 (5.6) | 92 (96) | 5.5 (6.2) |
| 4B2 | 11.5 | 6.0 (6.3) | 112 (118) | 5.2 (5.5) |
| 4C1 | 12.0 | 6.4 (6.4) | 126 (129) | 5.1 (5.3) |
| 4C2 | 11.5 | 6.3 (6.9) | 121 (126) | 5.2 (5.5) |

The following table illustrates the relation between initial modulus and secant modulus for selected fibers (six individual fibers indicated above as 2B2):

TABLE 1

| Twice - Drawn Fiber | Tenacity (g/den) | Secant Modulus (g/den) | Initial Modulus (g/den) |
|---|---|---|---|
| 2B2-1 | 7.5 | 125 | 285 |
| 2B2-2 | 7.4 | 135 | 285 |
| 2B2-3 | 7.4 | 116 | 213 |
| 2B2-4 | 7.3 | 118 | 250 |
| 2B2-5 | 7.6 | 138 | 247 |
| 2B2-6 | 7.2 | 119 | 218 |

Testing was conducted on an Instron machine with 5 inch (12.7 cm) sample lengths and a 5 inch/min (12.7 cm/min) head speed. Elongations were on the order of 0.3 inch (0.8 cm) or approximately 6%.

We claim:

1. A process comprising the steps:

(a) forming a solution of a substantially linear polyacrylonitrile having a weight average molecular weight at least about 500,000 in a first solvent at a first concentration of about 2 to about 15 weight percent polyacrylonitrile, (b) extruding said solution through an aperture, said solution being at a temperature no less than a first temperature upstream of the aperture and being substantially at the first concentration both upstream and downstream of said aperture, (c) cooling the solution adjacent to and downstream of the aperture to a second temperature below the temperature at which a rubbery gel is formed, forming a gel containing first solvent of substantially indefinite length, (d) extracting the gel containing first solvent with a second, volatile solvent for a sufficient contact time to form a fibrous structure containing second solvent, which gel is substantially free of first solvent and is of substantially indefinite length;

(e) drying the fibrous structure containing second solvent to form a xerogel of substantially indefinite length free of first and second solvent; and (f) stretching at least one of:

(i) the gel containing the first solvent, (ii) the fibrous structure containing the second solvent and, (iii) the xerogel, at a total stretch ratio sufficient to achieve a tenacity of at least about 5 g/denier and a secant modulus of at least about 100 g/denier.

2. The process of claim 1 wherein said aperture has an essentially circular cross-section; said gel containing first solvent is a gel fiber; and said xerogel is a xerogel fiber.

3. The process of claim 2 wherein said first temperature is between about 130° C. and about 250° C.; said second temperature is between about 0° C. and about 50° C.; and the cooling rate between said first temperature and said second temperature is at least about 50° C./min.

4. The process of claim 3 wherein said first solvent is dimethylsulfoxide, said first temperature is about 130° C. to about 200° C. and said first concentration is about 5 to about 8 weight percent.

5. The process of claim 4 wherein said first temperature is about 140° C. to about 180° C.

6. The process of claim 3 wherein said first solvent has a vapor pressure less than 80 KPa at said first temperature.

7. The process of claim 3 wherein said first solvent is selected from the group consisting of dimethylsulfoxide, dimethylformamide, dimethylacetamide, gamma-butyrolactone and ethylene carbonate.

8. The process of claim 7 wherein said first solvent is dimethylsulfoxide.

9. The process of claim 2 wherein said first solvent is selected from the group consisting of dimethylsulfoxide, dimethylformamide, dimethylacetamide, gamma-butyrolactone and ethylene carbonate.

10. The process of claim 9 wherein the said first solvent is dimethylsulfoxide.

11. The process of claim 2 wherein the total stretch ratio is about 5 to about 15.

12. The process of claim 2 wherein said stretching step (f) is conducted in at least two stages.

13. The process of claim 12 wherein a first stretching stage is of the gel containing the first solvent.

14. The process of claim 13 wherein a second stretching stage is of the gel containing the first solvent.

15. The process of claim 13 wherein a second stretching stage is of the xerogel.

16. The process of claim 12 wherein at least two stretching stages are performed on the xerogel.

17. The process of claim 2 wherein the stretching is primarily performed on the xerogel.

18. The process of claim 2 wherein at least a portion of stretching is performed at a temperature between about 130° C. and about 230° C.

19. The process of claim 18 wherein the stretching is performed in at least two stages with the latest stage performed at a temperature of between about 130° C. and about 230° C.

20. The process of claim 19 wherein said latest stage is performed on the xerogel.

21. The process of claim 2 wherein said polyacrylonitrile has a weight average molecular weight of at least about 750,000.

22. The process of claim 21 wherein said linear polyacrylonitrile has a weight average molecular weight of about 1,000,000 to about 4,000,000.

23. The process of claim 22 wherein said linear polyacrylonitrile has a weight average molecular weight of about 1,500,000 to about 2,500,000.

24. The process of claim 2 wherein said cooling step (c) includes immersing the solution in a quench bath containing a mixture of first solvent and water at a temperature of about 0° C. to about 50° C.

25. The process of claim 24 wherein said first solvent is dimethylsulfoxide.

* * * * *